United States Patent [19]

Paoli

[11] 4,429,511

[45] Feb. 7, 1984

[54] FINISHING DEVICE FOR PACKAGING CONTAINERS

[75] Inventor: Bruno Paoli, Fornacette, Italy

[73] Assignee: International Paper Company, New York, N.Y.

[21] Appl. No.: 302,392

[22] Filed: Sep. 15, 1981

[51] Int. Cl.[3] ..... B65B 7/04

[52] U.S. Cl. ..... 53/379; 53/375

[58] Field of Search ..... 53/379, 378, 375, 371, 53/372, 373; 198/631, 721

[56] References Cited

U.S. PATENT DOCUMENTS

| | | | |
|---|---|---|---|
| 2,068,241 | 1/1937 | Maxwell | 53/378 X |
| 2,179,685 | 11/1939 | Chalmers | 53/371 X |
| 2,584,529 | 2/1952 | Allen | 53/378 |
| 2,617,240 | 11/1952 | Monaco | 53/379 |
| 3,083,514 | 4/1963 | Smith et al. | 53/379 X |
| 3,227,263 | 1/1966 | Kastenbein | 198/631 X |
| 3,416,411 | 12/1968 | Hittenberger et al. | 53/375 UX |
| 3,469,364 | 9/1969 | Bischoff | 53/372 X |
| 3,492,781 | 2/1970 | Ray | 53/379 X |
| 3,810,314 | 5/1974 | Anderson | 53/378 |
| 4,313,290 | 2/1982 | Furuya et al. | 53/378 X |

*Primary Examiner*—James F. Coan

*Attorney, Agent, or Firm*—Bucknam and Archer

[57] ABSTRACT

A finishing device for treating and positioning flaps of containers which include (the usual) four triangular flaps. The device includes a longitudinal throughway or track provided with longitudinal flap-bending strips. After traversing the flap-bending portion of a track the containers are subject to a heat treatment which fixes the flaps to the desired surfaces of the containers.

7 Claims, 8 Drawing Figures

FINISHING DEVICE FOR PACKAGING CONTAINERS

Figure 1:
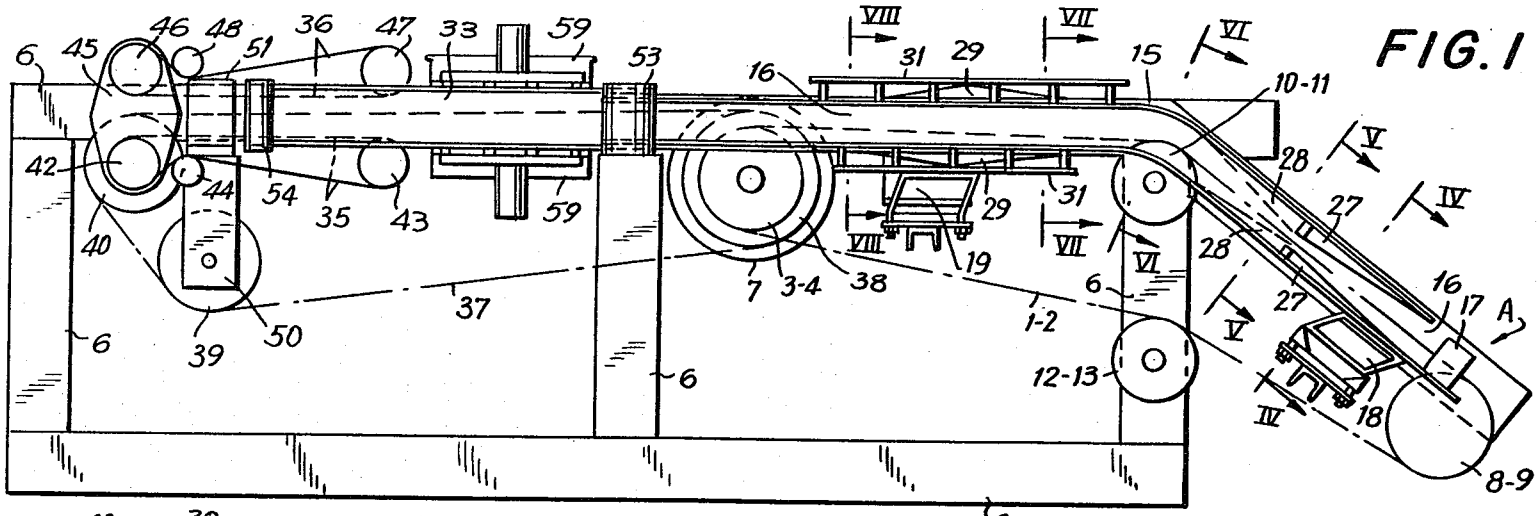

This invention concerns a finishing machine or device for packaging containers made of flexible materials, suitable in particular for packaging liquid food products.

The device according to this invention is particularly adapted for installation on machines for producing packaging containers made of flexible material in which starting from a continuous strip of heat-sealing material, a continuous tube is obtained which is then transformed into single packaging containers in the form of envelopes or packages, filled and sealed.

The known finishing devices for such containers often include components requiring back-and-forth motion, or otherwise interrupted motion (which characteristic therefore, in itself, involves a limitation of the operating capacity and also in the speed of packaging of the respective machine), or of continuously advancing motion, but with single spaced baskets, or include components which are each adapted for receiving a single container (which involves, in addition to a substantial complexity of construction, limited operating time for the performance of the various operations of finishing the containers). In the case of parallelepiped containers, the finishing operations involve the folding and attachment on the surfaces of the container of four triangular terminal flaps present on the container (produced in the phase of forming the parallelepiped). The bending of these flaps is accomplished by various methods which usually involve bending the flaps directly in the desired final direction on the several surfaces of the container. At the base of the flap in question, where several layers of packaging material are present, undesired bends generally result.

The object of this invention is therefore to obviate the disadvantages and limitations of the previous technique, by providing a finishing device for packaging containers equipped with a means for weakening the bases of said flaps in order to obtain an unobjectionable flap folding, as well as a means of simple construction, which will make possible a continuous web advance particularly adapted to the high operating speed of the packaging machine, and which will also make possible a final grouping of the containers in a tunnel with movable walls. Each single container thus has available an increased operating time for the finishing operations to which it is subjected, thus achieving a better final shape of the container.

The device according to this invention continuously receives single packaging containers from the packaging machine, filled and sealed, of approximately parallelepiped shape, with four protruding triangular flaps. The machine accomplishes automatically and continuously the finishing, i.e., the weakening, folding and attachment of said flaps on the several faces of the containers. The device consists, substantially, of the following: a stationary means for weakening and folding the container flaps in continuous movement, said means first folding the flaps of each container in one direction, and then in the opposite direction, until they are resting on the respective surfaces of the containers; a means of continuous movement, which receives in a cadenced or timed manner the individual containers from the source of feed, in general, directly from the respective packaging machine, and which transports continuously before said stationary means of weakening and bending, the containers spaced from each other, after which it determines the final grouping; and a means for the attachment of said flaps one the sides of the containers.

The stationary means for weakening and folding of the container flaps consists of a series of shaped longitudinal strips, attached in reciprocally opposite positions on two longitudinal plates, parallel to each other constituting, respectively, the base and top surface of a sliding runway for the containers which reach it in a cadenced manner from the feed source, generally direct from the respective packaging machine, said strips first bending the flaps of each container from their horizontal position toward the body of the container, and then returning them again to the horizontal position with the consequent effect of weakening of their base, and finally folding them against the upper and lower surfaces of the container, to which they are to be attached, or sealed.

The means of continuous movement comprises two endless chains, arranged on either side of the sliding run of the containers, the chains carrying a series of squares or similar components, equally spaced, each one of which pushes behind the other for a certain part of the course, against the rear surface of a container, and in the final part of its course, disengages from the container, thus permitting its grouping with the containers which are already downstream.

The base surface of the sliding track is also provided with a means of vibration which produces a vibrating motion vertically and horizontally at the same time, which motions brings about a substantial reduction of the friction which is otherwise pronounced and in any case harmful which exists between the containers in motion and the stationary metal components of the sliding track.

The means for attaching the flaps to the sides of the containers include components which prearrange, for attachment, the zones of each container involved in the attachment. For example, heating components blow, on the zones of the containers made of heat sealing materials, a flow of hot air for the heat-sealing of said flaps of the containers. Other components include a final tunnel with movable walls, consisting, for example, of an endless belt in continuous rotation, upon which is applied the necessary pressure for the attachment of said flaps.

Figure 2:
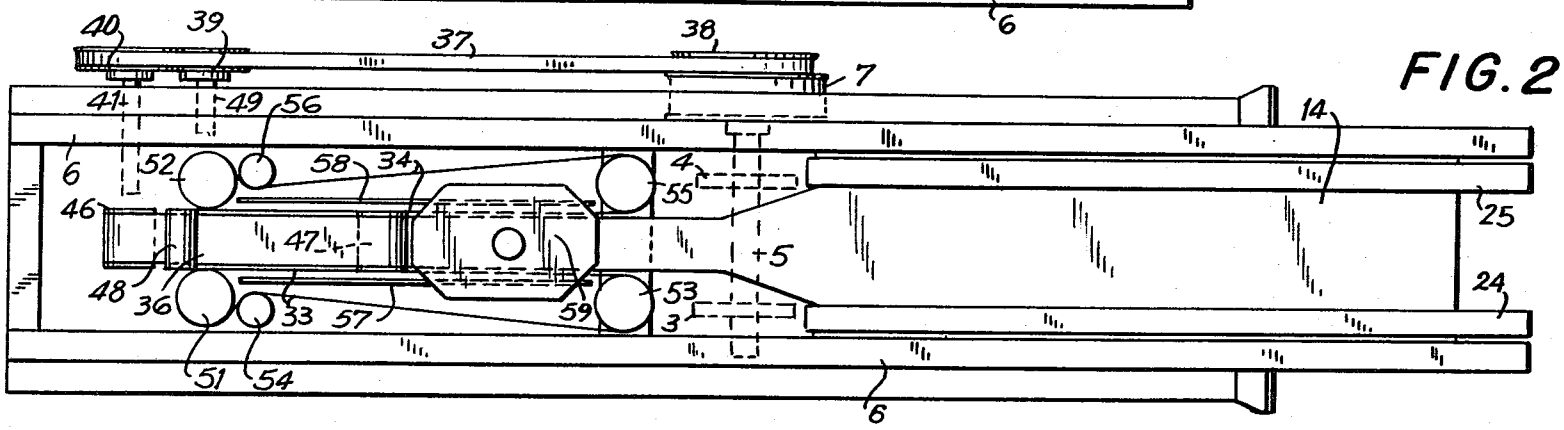
Figure 3:
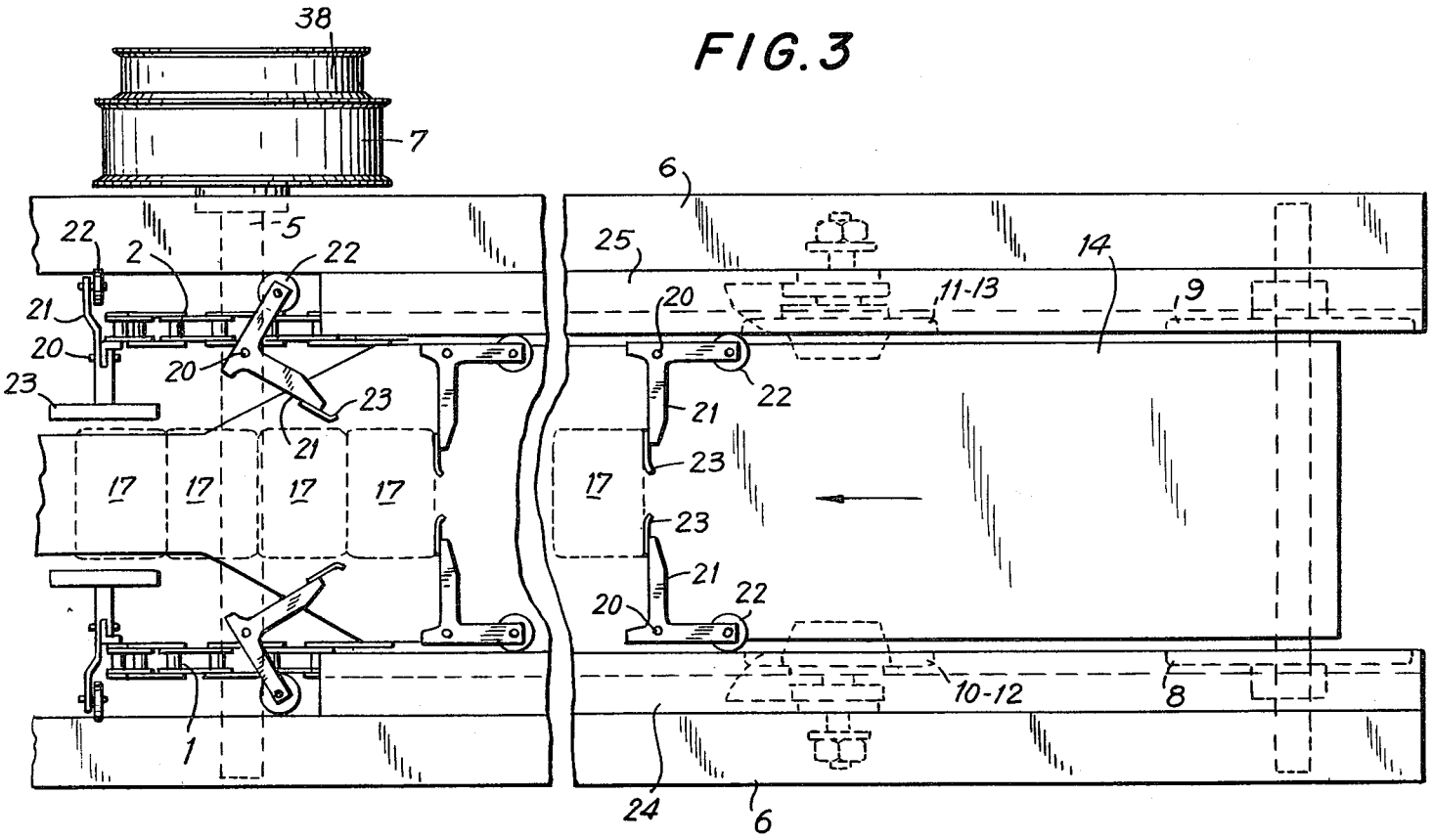
Figure 8:
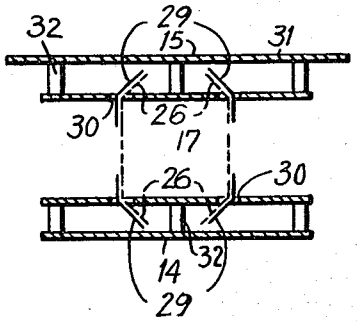
Figure 7:
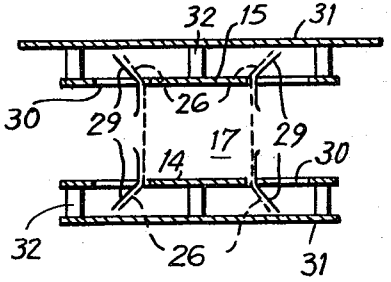
Figure 6:
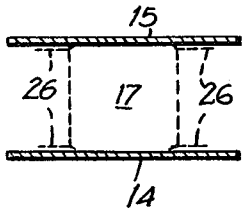

These and other characteristics of this invention will become more evident in the following detailed description of an illustrative embodiment, with reference to the attached drawings, in which:

FIG. 1 is a schematic side view of a device according to this invention, with some components deleted for greater clarity of representation, FIG. 2 is a schematic top view of FIG. 1, with some components deleted, FIG. 3 is a schematic top view with respect to the right-hand side of FIG. 1, FIGS. 4 to 8 are schematic sections, respectively, along lines IV—IV, V—V, VI—VI, VII—VII, and VIII—VIII of FIG. 1.

With reference now to the figures, the device according to the invention defines a system of continuous motion including two endless chains arranged side by side and parallel to each other, the chains being driven by means of coaxial reels 3 and 4 splined to a drive shaft 5 supported by the frame 6 of the device. The shaft also drives a toothed pulley 7, the shaft receiving power from a principal drive component, not shown. The chains 1 and 2 are guided on the terminal reels 8 and 9, and on intermediate reels, 10, 11, and 12, 13 (see right portion of FIG. 1).

Between the upper branches or runs of the two chains 1 and 2 are appropriately supported two oppositely disposed longitudinal plates, namely a lower plate 14 and an upper plate 15, of the same general configuration. These two longitudinal plates define, respectively, the base and top surface of a sliding track 16 for packing containers 17 which reach the track in a cadenced manner, corresponding to position A of the feed source (right portion of FIG. 1). These containers 17, previously produced (in a manner not forming any part of this invention) filled and sealed, in an approximate parallelepiped shape, having the usual four terminal triangular flaps extended, can be fed directly to said sliding track from an automatic packaging machine.

The longitudinal plate 14 is caused to vibrate by means of two electromagnetic devices 18 and 19 which produce, in the inclined section and in the horizontal section of plate 14, a vibrating motion not only in the vertical direction, but also a translational motion. This characteristic of movement imposed upon the sliding plane of the container ensures a notable reduction of the friction, otherwise pronounced and in any case harmful, between the containers in motion and the stationary surfaces over which they slide. With regard to the vibrations of plate 14, it is obvious that the reduction of friction does not depend upon any fixed relation between the vibratory frequency and the frequency exciting the vibrators 18 and 19. Further, any vibratory system such as a mechanical one may be used.

Each one of the chains 1 and 2 carries arms 21 pivoted at 20 to the chains (FIG. 3, only a few being shown for the sake of simplicity). Each arm carries at one end a roller 22 and at theother end a tab 23. Each corresponding pair of arms 21 is held in a thrust position with the two tabs 23 against a container 17 by virtue of the presence, between the rollers 22, of two stationary guides 24 and 25. The spacing between the arms as well as the speed of chains 1 and 2 are naturally adapted to the rate of feed of containers 17 onto sliding track 16. Each arm of a chain and the corresponding arm of the other chain receive a container 17 in the respective position A of the sliding track and push it ahead from the rear, causing it to slide over the vibrating plate 14. The inclination of the first section of the sliding track increases the rear support force of each container against the respective pair of pushing arms, thus producing the correct position of the container at the moment of its impact against the base surface of the sliding track.

In the final section of chains 1 and 2, where guides 24 and 25 terminate, the arms 21, now no longer pressing with their rollers against these guides, rotate as shown in the left-hand portion of FIG. 3, on account of the sliding function of their tabs 23 against the lateral surfaces of the containers, and they no longer exert any thrust against the containers. Then, in leaving the chain transportation system, the single packaging containers, previously spaced between each other, now find themselves grouped together without interrupting their continuity, and in this arrangement they continue their advance toward the successive parts of the device.

Figure 4:
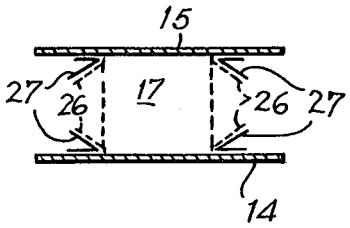
Figure 5:
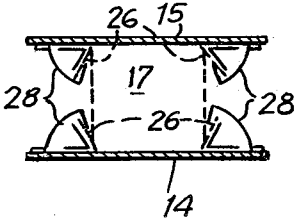

The weakening and bending of the four triangular terminal flaps 26 of each container 17 are carried out by means of a series of shaped longitudinal strips. These strips are attached in position relative to plates 14 and 15 and act laterally against the containers during their continuous motion of advance along the sliding track 16. The containers 17, as they travel, present the usual four triangular flaps 26 extending horizontally over the planes of their upper and lower surfaces. In a first phase, flaps 26 are progressively caused to rotate, from their horizontal position toward the body of the container 17 by means of the shaped strips 27 (FIG. 4). Simultaneously with the bending of the flaps 26, the thrust of container 17 is upward, against the upper stationary plate 15 due to the effect of the vibrating motion given to the lower plate 14 of vibrator 18. In the second phase of the bending, carrying out thereby the weakening of their base, by means of (downstream) shaped strips 28 (FIG. 5). According to section VI—VI (FIG. 6), or in the junction between the inclined section and the horizontal section of sliding track 16, the container 17 maintains its flaps 26 horizontally. In the horizontal section of the sliding track (FIGS. 7 and 8), by means of (downstream) shaped strips 29, the flaps 26 are finally bent 180° against the upper and lower surfaces of container 17 onto which they are then sealed. The numeral 30 indicates the longitudinal slots in this portion of plates 14 and 15 for the passage of flaps 26 during the 180° bending. The numerals 31 and 32 denote the components which support the portions of plates 14 and 15 which would otherwise be left unsupported due to slots 30.

After leaving the guided thrust system, consisting essentially of thrust arms 21, base plate 14 and top plate 15 of the sliding track, and of the strips 27, 26, etc. for weakening and bending the flaps of the containers, the containers are completely grouped together, ready for the successive phases of attachment of their flaps and at the same time they are pushed into a tunnel. The tunnel has vertical and horizontal walls formed, respectively, by two endless vertically disposed bands 33 and 34 and also formed by two endless horizontally disposed bands 35 and 36, above and below the track 16 respectively. These four endless bands are kept in continuous motion are are synchronized with the motion of thrust chains 1 and 2. The motion to the containers 17 is given by means of belt 37, driven by a pulley 38 (splined onto the drive shaft 5) and guided on drive wheels 39 and 40. A shaft 41 turns wheel 40 and also turns drive pulley 42 which turns band 35, the latter guided onto a drive wheel 43 and on a tension roller 44. Shaft 41 by means of its connection to gears mounted in a housing 45, likewise transmits rotary motion to drive pulley 46 of band 36, the latter passing over guided drive wheel 47 and onto a tension roller 48. Shaft 49 is coupled to wheel 39 and also transmits motion by means of bevel gears housed in a box 50, to two vertical shafts arranged on either side of the horizontal bands 35 and 36 and holding on their upper end the drive pulleys 51 and 52 of the vertical bands 33 and 34 passing over the drive wheels and tension rollers 53 and 55, and 54 and 46, respectively. The two vertical, lateral bands 33 and 34 are held in their correct rectilinear operating position by means of pins (not shown) and two respective horizontal grooves in two stationary beams 57 and 58.

In the initial part of the tunnel, only two moving walls, consisting of vertically disposed bands 33 and 34, act on containers 17. In this section of the container advance, the containers are subjected, at their top and bottom, to a stream of hot air fed from a heating unit 59. By virtue of the resultant heating effect, the portions of the containers which require heat-sealing of the terminal flaps 26 are appropriately heated. After passing through heater unit 59, the containers are engaged by horizontal bands 35 and 36 and in this final section of the tunnel, during the advance of the containers 17, necessary pressure is exerted in order to effectively seal the terminal flaps 26 to the sides of the containers. Each container is closed on all of its sides and therefore it assumes an optimum final shape.

I claim:

1. A device for the finishing of filled and sealed packaging containers which are at least approximately of parallelepipedal shape and having the usual four protruding terminal flaps, comprising moving means for producing continuous movement along a sliding track of the containers which are received in a cadenced manner from a feed source, the sliding track includes an upper plate and a lower plate spaced apart from said upper plate, a plurality of stationary weakening and bending elements of said flaps of the containers, disposed in series along a portion of said track, said elements being attached in opposite positions parallel to each other, the positions being located at respectively the lower plate and the upper plate, said elements bending the flaps of each container from their horizontal position, first in one direction and then in the opposite direction with a consequent effect of weakening their base, thereafter folding them against the upper and lower surfaces of the container and means for attaching said flaps to the sides of the container.

2. A device according to claim 1, wherein the device includes means for vibrating said lower plate and the sliding track comprises a first inclined portion and a second horizontal portion, said stationary means of weakening and bending consists of a series of shaped longitudinal strips, said strips causing the flaps of each container to rotate from their horizontal position toward the body of the container, while the thrust of the container is against said upperplate, then bending the flaps and causing them to return to their horizontal position against the upper and lower surfaces of the container.

3. A device according to claim 2 wherein said moving means for producing continuous movement includes two endless chains, driven by a common drive shaft and installed on either side of the sliding track for the containers, and bearing a series of equally spaced arms each one of which pushes from behind, for at least certain part of its travel, against the rear surface of a container, and in the last part of the travel disengages from the container, allowing it to group together with other containers which are already downstream, and wherein said arms are disposed to travel between said upper plate and said lower plate and are disposed to travel alongside said strips.

4. A device according to claim 3, wherein said lower plate of the sliding track is provided with vibration means for vibrating it in two directions, said vibrations producing a simultaneous vertical and translational vibration of said lower plate.

5. A device according to claim 4, wherein said vibrating means includes a first vibrator mounted on said inclined track section for operating at a first vibration frequency, and includes a second vibrator mounted on said flat track section for operating at a second vibration frequency.

6. The device according to claim 2 wherein the flaps return to their horizontal position at the junction of said inclined portion and said horizontal portion of the track.

7. A device according to claim 1 which comprises a tunnel downstream of said weakening and bending elements, said tunnel having movable walls comprising vertically disposed bands, heating means for top and bottom heating of the containers while the containers slide along said track between said vertically disposed bands, said tunnel having horizontal bands downstream of said vertically disposed bands for engagement of the containers and for exerting pressure for attachment of said flaps to the surfaces of said container.

* * * * *